US006543873B1

(12) United States Patent
Van Veen

(10) Patent No.: US 6,543,873 B1
(45) Date of Patent: Apr. 8, 2003

(54) METHOD OF IMPROVING THE IMAGE QUALITY OF A PRINT JOB

(75) Inventor: Mark A. Van Veen, Cardiff by the Sea, CA (US)

(73) Assignee: Hewlett-Packard Company, Fort Collins, CO (US)

( * ) Notice: Subject to any disclaimer, the term of this patent is extended or adjusted under 35 U.S.C. 154(b) by 0 days.

(21) Appl. No.: 09/983,816

(22) Filed: Oct. 26, 2001

(51) Int. Cl.[7] ..... B41J 29/393
(52) U.S. Cl. ..... 347/19
(58) Field of Search ..... 347/19, 14, 23, 347/37, 29, 32, 33, 10, 12, 5, 40; 400/283, 303

(56) References Cited

U.S. PATENT DOCUMENTS 5,214,447 A * 5/1993 Iwata ..... 347/30
5,539,434 A * 7/1996 Fuse ..... 347/19
5,815,175 A * 9/1998 Seikel ..... 347/23
6,318,839 B1 * 10/2000 Elgee ..... 347/37

* cited by examiner

*Primary Examiner*—Hai Pham
*Assistant Examiner*—Charles W. Stewart, Jr.

(57) ABSTRACT

A method, system and apparatus for improving the image quality of a print job. In the method, a print job having a print length and a print width is initiated. The print job is paused in response to at least one of the print length and the print width exceeding a modifiable servicing interval. A service strip is printed and evaluated to determine whether the image quality of the print job is above a predetermined quality threshold. The print job is resumed in response to the print job being above the predetermined quality threshold. In the system, a printer is controlled by processor to initiate the print job, pause the print job, and print the service strip as required. The service strip is sensed by a sensor system and data associated with the sensing of the service strip is relayed to the processor for evaluation. In response to the print job being above the predetermined quality threshold, the printer is controlled by the processor to resume the print job. In the apparatus, a printhead, controlled by a controller, is configured to print the print job and the service strip on a print medium. A sensor senses the service strip and relays the data to the controller. In this regard, the controller is further configured to evaluate the service strip and, in response to the print job being above the predetermined quality threshold, control the printhead to resume the print job.

28 Claims, 6 Drawing Sheets

METHOD OF IMPROVING THE IMAGE QUALITY OF A PRINT JOB

FIELD OF THE INVENTION

This invention relates generally to printers, and more particularly, although not exclusively, to improving the image quality of a print job.

BACKGROUND OF THE INVENTION

It is generally known that inkjet printers utilize at least one printhead possessing a plurality of nozzles through which ink drops are fired onto a medium, e.g., fabric, paper, vinyl etc., to create an image on the medium, e.g., plot, drawing, etc. According to one type of inkjet printer, ink is typically supplied substantially continuously over a plurality of resistors generally located beneath the openings of the nozzles. In use, certain of the resistors are activated, i.e., heated, to vaporize a portion of the ink on the resistors, thereby causing a portion of the ink to be fired through the respective nozzle openings. According to another type of inkjet printer, ink is typically supplied substantially continuously over a plurality of piezoelectric elements located beneath the openings of the nozzles. In this type of printer, certain of the piezoelectric elements are caused to deform at a relatively rapid rate, thereby causing ink positioned thereover to be fired through the respective nozzle openings to produce pixels.

To create an image on the print medium, the printer typically controls the nozzles to produce a pattern of pixels corresponding to the image. The nozzles are generally arranged on one or more printheads that travel back and forth across the surface of the print medium. In this regard, FIG. 1 illustrates a conventional large format inkjet printer 110 having a pair of legs 114, left and right sides 116, 118, and a cover 122. The printer 110 includes a carriage 100 supporting a plurality of printheads 102–108. The carriage 100 is coupled to a slide rod 124 with a coupling 125. As is generally known to those of ordinary skill in the art, during a printing operation, the carriage 100 travels along the slide rod 124 generally in a Y-axis direction 103 to make a printing pass, typically from the right side 118 to the left side 116 of the printer 110. In addition, as the carriage 100 travels along the Y-axis 103, certain of the printheads 102–108 drop or fire ink onto a medium 130 through a plurality of nozzles (not shown).

Typically, the medium 130 travels in an X-axis direction 101 at certain times during the printing operation. By virtue of performing a plurality of printing passes over the medium 130 by the carriage 100 in the above-described manner, an image, e.g., plot, text, and the like, may be printed onto the medium.

Also illustrated in FIG. 1 is a printer control panel 120 located on a right side 118 of the large format inkjet printer 110. The printer control panel 120 typically functions as an interface between a user and the printer 110 to enable certain printer operations to be set (e.g., medium advance, printmode, etc.). In addition to housing the printer control panel 120, the right side 118 of the printer 110 typically also houses printer components for performing printing operations (e.g., printer electronics, a service station for servicing operations on the printheads 102–108, etc.).

In performing printing operations with inkjet printers, it is generally known that the print quality and the throughput, i.e., amount of time required to print a plot, may be inversely related. That is, to increase throughput, the print quality is oftentimes sacrificed, or vice versa. To maintain a preferred level of print quality, servicing operations are typically performed on the printheads 102–108. In this respect, although not shown in FIG. 1, inkjet printers typically possess a service station located ("spittoon") to perform the above-described servicing operations on the printheads 102–108.

There are generally two ways in which the nozzles of the printheads 102–108 may be "refreshed", i.e., cleaned. The nozzles may be refreshed by firing ink drops onto the medium 130, i.e., printing, or by spitting ink drops into the spittoon. Thus, those nozzles of the printheads 102–108 that actively drop ink onto the medium typically are not required to spit into the spittoon during various printing passes.

If it is preferred to increase throughput, the number of servicing operations performed on the printheads 102–108 may be reduced. In this respect, the length of time between the servicing operations may also be increased. One problem associated with increasing the length of time between servicing operations is that the properties of fired ink drops may deteriorate, thereby compromising the print quality. For example, ink in position to be fired from the nozzle may become dried and thus not fired through the nozzle. This effect is generally referred to as "decap" and typically occurs when a maximum amount of time a nozzle may be idle (i.e., not firing or spitting ink drops) before an ink drop may be ejected from that nozzle is exceeded. In addition, "slewing decap" generally refers to the maximum amount of time a nozzle may be idle during a pass across a medium. Moreover, because the nozzles are moving, the effects of "slewing decap" on the nozzles are typically worse than "decap". As a consequence, slewing decap times are generally shorter than decap times.

To reduce the negative effects of decap, the spittoon typically performs servicing operations on the printheads as well as capping the nozzles when the printheads are idle for a certain period of time. For example, the printheads typically spit ink into the spittoon at various times during a printing operation to substantially prevent the occurrence of decap. Additionally, the spittoon may also include a mechanism for wiping the nozzles of the printheads at various times to generally attempt to wipe off ink dried in the nozzles. Although the performance of the above-stated servicing operations on the printheads has been found to relatively increase the life of the printheads as well as the quality of the printed image, one disadvantage of performing a relatively large number of servicing operations is that the throughput may become compromised.

A typical workflow utilized by the large format (i.e., 40 inches or more) inkjet (e.g., thermal, piezoelectric cell, etc.) printing industry follows. A print job is initiated. For example, a poster, is sent to the printer. Some startup time may pass (e.g., a few seconds or so) as the job is being processed through the pipeline and the printer is getting ready to print the job. During the startup time, the printer typically takes this opportunity to perform actions that may result in lowering the rate of defects. For example, the servicing protocols mentioned above. In addition, the printer may have performed servicing at startup i.e., when the printer was turned on. To continue, the job is printed as described above. The job length is defined typically by the length of the file, for example the size of the poster. Once the job has finished printing, the print medium is typically cut and the printer may perform one or more servicing actions prior to the next job. This particular series of events (i.e., workflow) is generally utilized by the large format inkjet printing industry.

In the textile printing industry, however, a number of differences may be noted. For instance, the print medium is relatively larger. In this regard, fabric mills typically produce fabric five meters wide and several hundred meters long. Each of two sides or edges of the fabric are termed "selvage". Typically, the selvage is woven differently to reduce tearing and fraying of the material. The fabric is generally rolled to facilitate transport and handling. The roll is then transported to a textile printing mill.

A typical workflow utilized by the textile printing industry follows. The textile mill receives the roll and load it into a processing machine. Typically the machine unrolls the fabric, washes and bleaches the fabric. As processing continues, a tensioner is utilized to remove wrinkles. The tensioner grasps each selvage edge of the fabric and stretches the fabric to remove any wrinkles i.e., a form of ironing. The fabric may be processed through a series of presses to further reduce wrinkles and relieve mechanical stress of the fabric.

Rotary silkscreen printing presses are typically utilize by the textile industry. In a relatively fast (e.g., thousands of meters per hour) and substantially continuous process, the fabric is glued to a belt, printed, removed from the belt, cleaned, and rolled or cut and stacked. The belt is generally a perforated rubber mat, about three meters wide and about thirty meters long. The belt is heated and dried. A glue is spread over the belt and the fabric is pressed on the belt. Heat is applied to set the glue. At this point, the fabric is generally ready for printing.

Rotary silkscreen tubes are placed on the fabric. The surface of tubes have been processed to form an image. The image on the surface of the tube is permeable to ink. Ink is sprayed in the tubes and a magnetic knife within the tube acts as a "squeegee" to spread the ink over the inside of the tube. The tubes roll as the fabric moves underneath and the image is transferred to the fabric. The fabric is pulled off the belt at an angle. Relatively high-pressure water nozzles underneath the fabric are utilized to remove the glue from the fabric and the glue covered surface of the belt is cleaned as it travels back to have more fabric attached.

Typically, every color is mixed. For example, when printing a light blue, a light blue ink may be mixed and sprayed in the rotary silkscreen tube. In addition, another form of color mixing such as spot color (i.e., producing a final color by mixing more than one color directly on the fabric) may also be utilized. However, process imaging, as is performed in the inkjet industry is generally not performed. Furthermore, rotary silkscreen printing presses may utilize twenty or more color stations whereas inkjet printing generally utilizes eight or fewer colors.

In the textile printing industry, the defect rate is relatively important. For example, relatively high-end print medium (e.g., silk, linen, wool, etc.) may cost more than one hundred dollars for each meter length. The cost of the inks used in textile printing is relatively expensive as well. A significant defect may effectively ruin as much as ten meters of material. Thus, conventional rotary silkscreen printing has developed into a relatively robust printing system. Typical defect rates are approximately four defects per six hundred meters. A convention inkjet printer may have a defect rate of ten to fifty times the defect rate of a conventional rotary silkscreen printing press. However, the cost for a typical rotary silkscreen press may exceed five million dollars compared to a few thousand dollars for an inkjet printer.

SUMMARY OF THE INVENTION

In one respect, the invention pertains to a method for improving the image quality of a print job. In the method, a print job having a print length and a print width is initiated. The print job is paused in response to at least one of the print length and the print width exceeding a modifiable servicing interval. A service strip is printed and evaluated to determine whether the image quality of the print job is above a predetermined quality threshold. The print job is resumed in response to the print job being above the predetermined quality threshold.

In another respect, the invention pertains to a system for improving the image quality of a print job. In the system, a printer is controlled by a processor to initiate the print job having a print length and a print width. In response to at least one of the print length and the print width exceeding a modifiable servicing interval, the printer is controlled by the processor to pause the print job and print a service strip on a print medium. The service strip is sensed by a sensor system and data associated with the sensing of the service strip is relayed to the processor. The data associated with the sensing of the service strip is utilized by the processor to evaluate the service strip and determine whether the image quality of the print job is above a predetermined quality threshold. In response to the print job being above the predetermined quality threshold, the printer is controlled by the processor to resume the print job.

In yet another respect, the invention pertains to an apparatus. The apparatus includes a printhead configured to print on a print medium and a controller configured to control the printhead to print a print job having a print length and a print width on the print medium. The controller is further configured to control the printhead to pause the print job and print a service strip on the print medium in response to at least one of the print length and the print width exceeding a modifiable servicing interval. The apparatus further includes a sensor configured to sense the service strip and relay data associated with the sensing of the service strip to the controller. In this regard, the controller is further configured to evaluate the service strip based on the data associated with the sensing of the service strip and determine whether the image quality of the print job is above a predetermined quality threshold based on the evaluation of the service strip. In response to the print job being above the predetermined quality threshold, the controller is further configured to control the printhead to resume the print job.

In comparison to known prior art, certain embodiments of the invention are capable of achieving certain aspects, including some or all of the following: (1) saves user's time; (2) improves printer servicing protocol; and (3) reduces printer error rate. Those skilled in the art will appreciate these and other aspects of various embodiments of the invention upon reading the following detailed description of a preferred embodiment with reference to the below-listed drawings.

DETAILED DESCRIPTION OF A PREFERRED EMBODIMENT

For simplicity and illustrative purposes, the principles of the invention are described by referring mainly to an exemplary embodiment thereof, particularly with references to an inkjet printing system utilizing a fabric medium. However, one of ordinary skill in the art would readily recognize that the same principles are equally applicable to, and may be implemented in, any system capable of printing on any medium, and that any such variations are within the scope of the invention. While in the following description numerous specific details are set forth in order to provide a thorough understanding of an embodiment of the invention, in other instances, well known methods and structures have not been described in detail so as not to obscure the invention. Furthermore, the terms "connected" and its variants, as used herein, mean connected directly or indirectly through an intermediary element.

Figure 1:
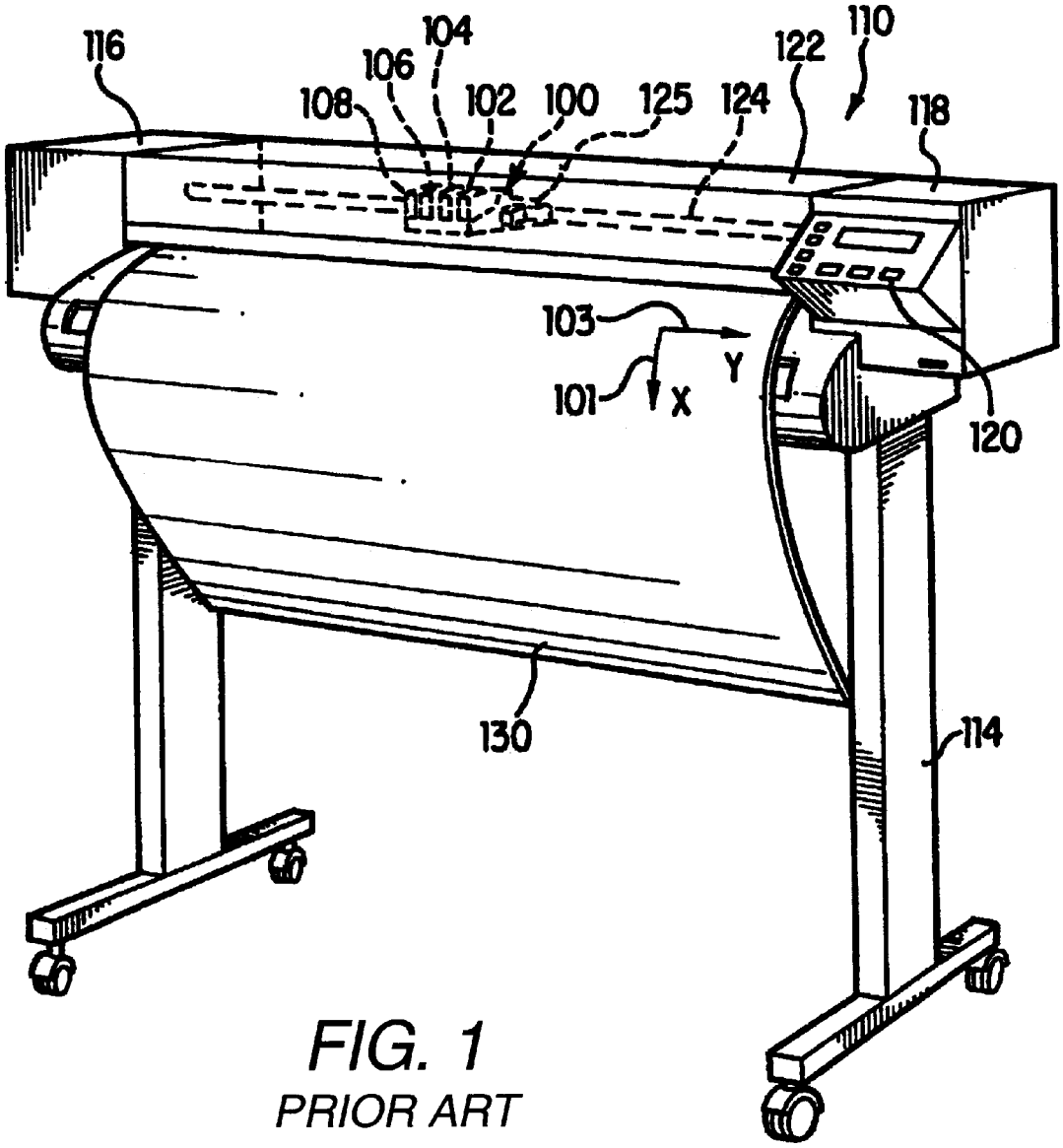
FIG. 1 PRIOR ART
FIG. 1 illustrates a conventional large format printer.
Figure 2:
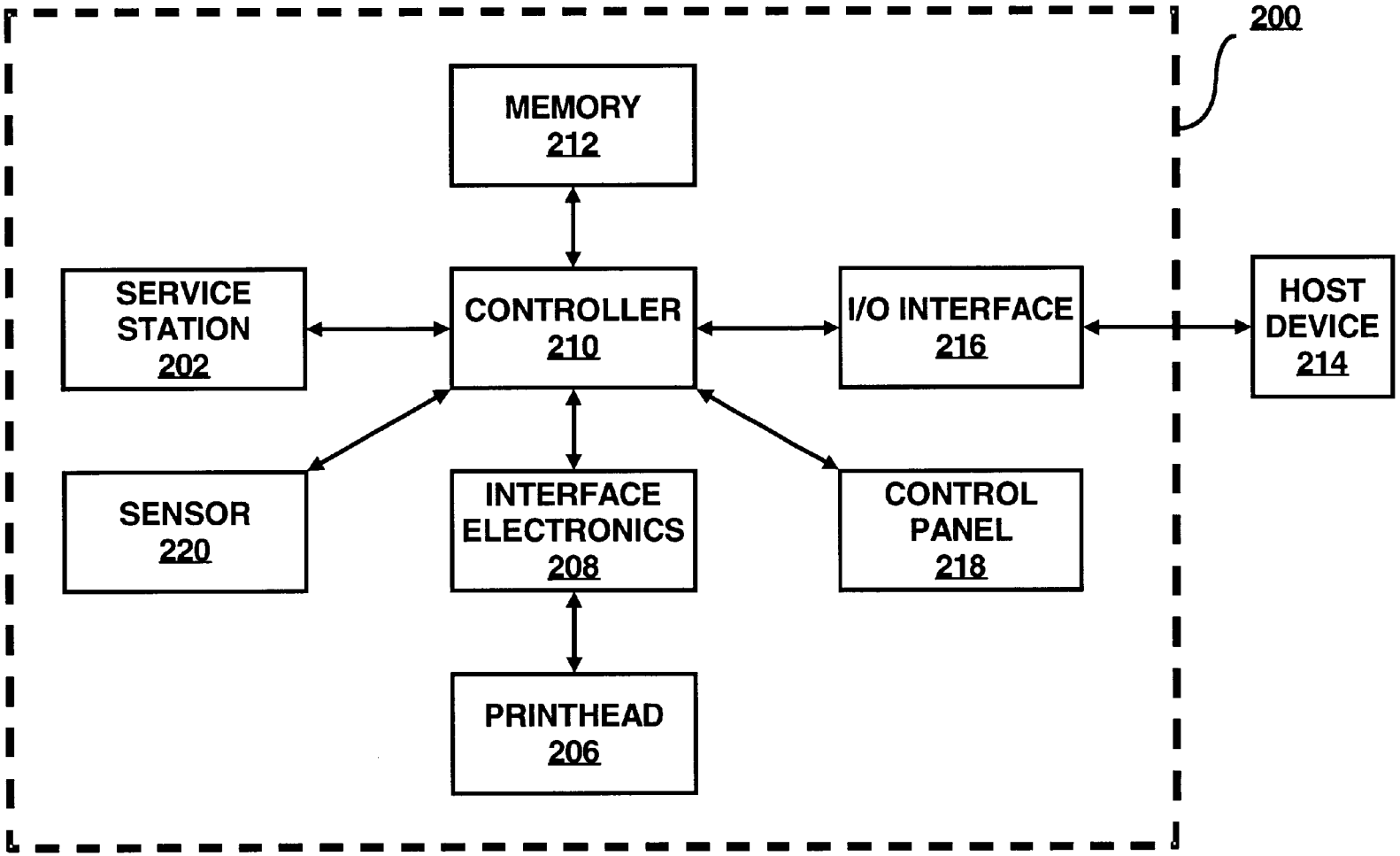
FIG. 2 is a block diagram of a system according to an embodiment of the invention.

Referring to FIG. 2, there is illustrated an exemplary block diagram of a printer 200 in accordance with the principles of the present invention. The following description of the block diagram illustrates one manner in which a printer may be operated in accordance with the principles of the present invention. In this respect, it is to be understood that the following description of the block diagram is but one manner of a variety of different manners in which such a printer may be operated.

Generally speaking, the printer 200 includes a printhead 206, although a plurality of printheads may be included. The description of one printhead 206 is for purposes of simplicity and is not meant as a limitation. In this regard, the printer 200 may include any reasonably suitable number of printheads, e.g., two, four, six, and the like, configured to operate in the manner described hereinbelow with respect to the printhead 206. In addition, the printer 200 is illustrated and described in terms of a large format inkjet printer; however, it should be understood and readily apparent to those skilled in the art that the service strip configuration technique disclosed herein may be implemented in any reasonably suitable type of printer without departing from the scope of the invention.

The printhead 206 may be configured to repeatedly pass across a medium in individual, horizontal swaths or passes during a printing operation to print a particular image (e.g., picture, text, diagrams, etc.) onto the medium. In addition, the printhead 206 may be configured to contain a plurality of nozzles (not shown) operable to be implemented during each pass to apply an ink pattern onto the medium and thus print the particular image. In this regard, the printhead 206 may comprise a conventional thermal inkjet printhead or a conventional piezoelectric printhead, both of which are generally known to those skilled in the art.

The printer 200 may also include interface electronics 208. The interface electronics 208 may be configured to provide an interface between a controller 210 of the printer 200 and the components for moving the printhead 206, e.g., a carriage, belt and pulley system (not shown), etc. The interface electronics 208 may include, for example, circuits for moving the printhead 206, moving the medium, firing individual resistors or piezoelectric elements in the nozzles of the printhead, and the like.

The controller 210 may be configured to provide control logic for the printer 200, which provides the functionality for the printer. In this respect, the controller 210 may possess a microprocessor, a micro-controller, an application specific integrated circuit, and the like. The controller 210 may be connected to a memory 212 configured to provide storage of a computer software that provides the functionality of the printer 200 and may be executed by the controller 210. The memory 212 may also be configured to provide a temporary storage area for data/file received by the printer 200 from a host device 214, such as a computer, server, workstation, and the like. The memory 212 may be implemented as a combination of volatile and non-volatile memory, such as dynamic random access memory ("RAM"), EEPROM, flash memory, and the like. It is also within the purview of the present invention that the memory 212 may be included in the host device 214.

Although the host device 214 is depicted as distinct from the printer 200, it is widely known that the functionality of the host device 214 may be subsumed within the printer 200. For example, an electronic typewriter or a printer/scanner/fax/copier machine may incorporate some or all of the functionality of the host device 214 within the printer 200.

The controller 210 may further be connected to an I/O interface 216 configured to provide a communication channel between a host device 214 and the printer 200. The I/O interface 216 may conform to protocols such as RS-232, parallel, small computer system interface, universal serial bus, etc. In addition, the controller 210 may be connected to a service station 202.

Also depicted in FIG. 2 is a control panel 218. The control panel 218 may be configured to provide a user the capability to select various printer options (e.g., medium advance, printmode, etc.) and display various information to the user (e.g., printer status, error codes, etc.). In this regard, the control panel 218 may be connected to the controller 210. Thus, the controller 210 may receive user selections and send information to the user via the control panel 218. Additionally, some or all of the functionality of the control panel 218 may be duplicated or subsumed within the host device 214.

The printer 200 may further include a sensor 220 e.g., an optical sensor. The sensor 220 may be operable to sense content applied to a print medium. The sensor 220 may be configured to relay data associated with the sensing of the content to the controller 210.

In the following description of FIGS. 3A and 3B, a service strip may defined as a printed diagnostic indicator of nozzle condition. Typically, the service strip may include a set of wakeup bars, nozzle patterns, etc. Additionally, the service strip may include printed patterns that tend to show problems associated with dot placement. The service strip may be scanned by an optical sensor such as the sensor 220 illustrated in FIG. 2. For example, the optical sensor may be located on the carriage. Data corresponding to the scan of the service strip may be compared to a stored file of expected values. Based on the comparison, servicing operations may be performed, nozzles may be remapped, error codes may be generated, etc. Furthermore, various other types of printing systems (e.g., electrophotographic, offset, and the like) may utilize diagnostic printed patterns to identify problems associated with color, placement, alignment etcetera and thus, may be within the scope of the invention.

Figure 4:
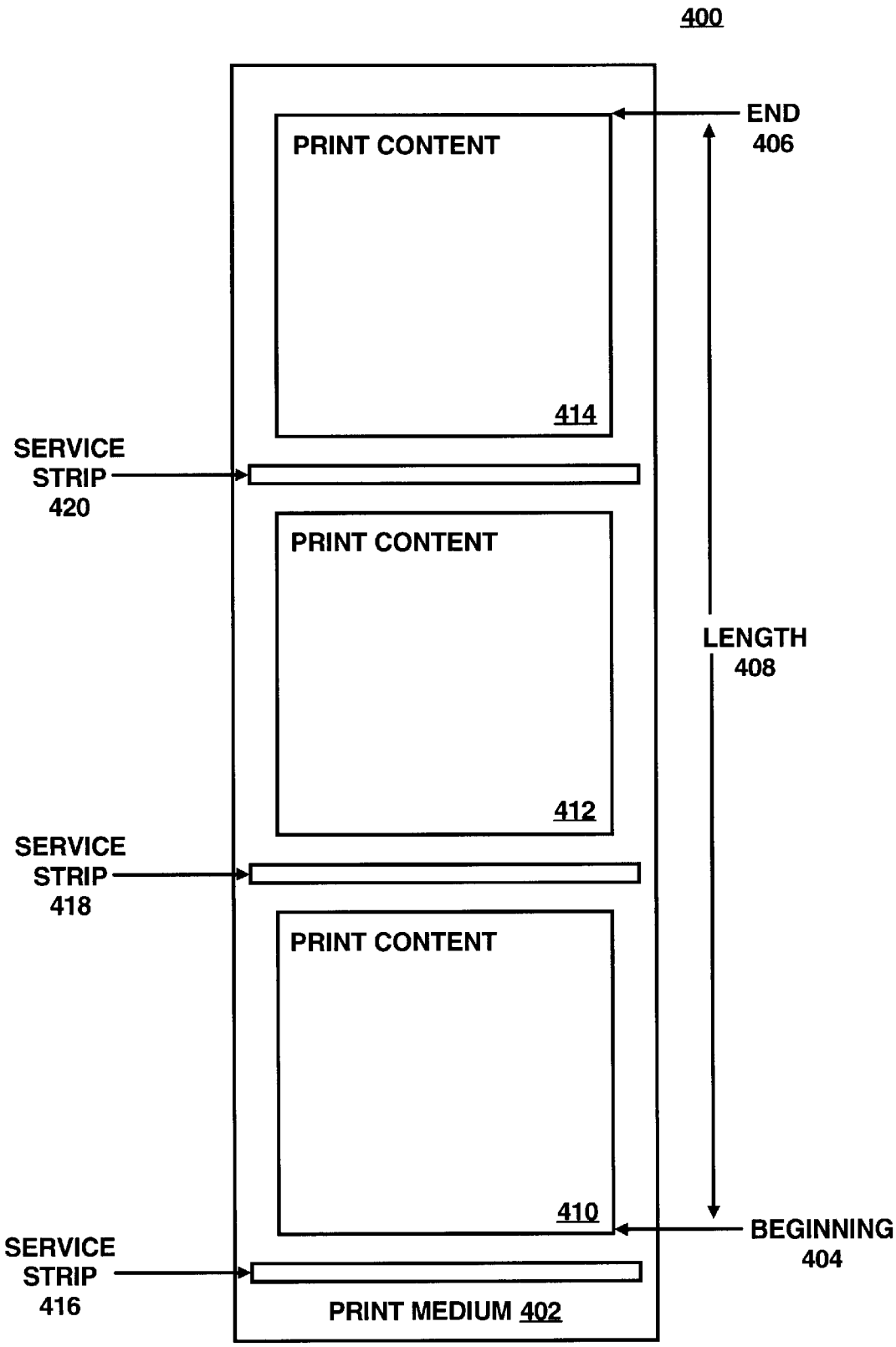
FIG. 4 is an illustration of an exemplary manner in which a servicing interval may be defined according to an embodiment of the invention.
Figure 5:
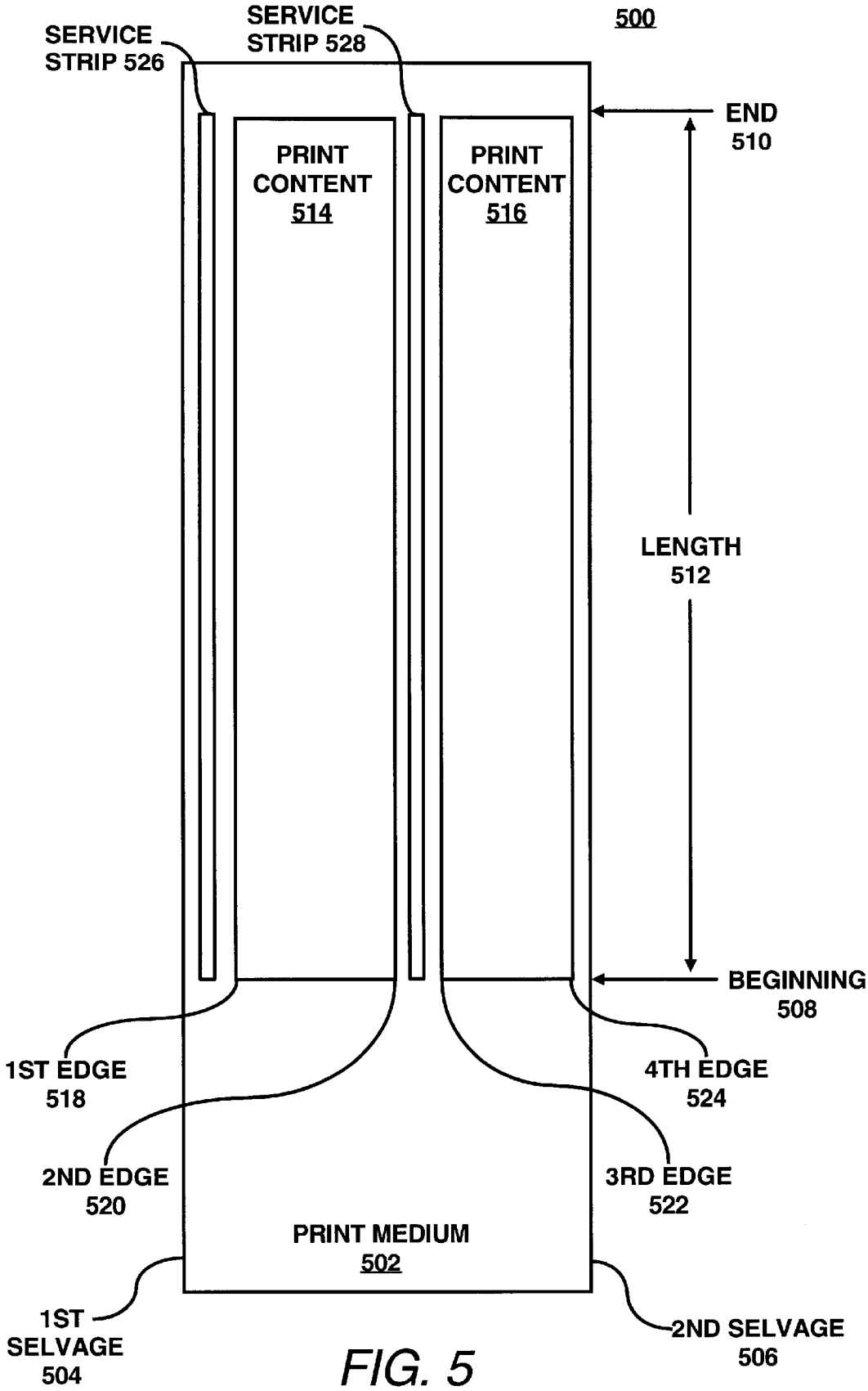
FIG. 5 is an illustration of another exemplary manner in which a servicing interval may be defined according to an embodiment of the invention.

Moreover, a servicing interval is defined as a measured length or width of print medium between two service strips. As depicted in FIG. 4, the servicing interval may further be defined as the measured length of print medium between the beginning of a print job and a service strip, as well as between a service strip and the end of a print job. Additionally, as depicted in FIG. 5, the servicing interval may further be defined as the measured width of print medium between an edge of the print medium (e.g., selvage) and a service strip. Furthermore, it is within the scope of the invention that some combination of width and length measurements be utilized to define the servicing interval.

Figure 3A:
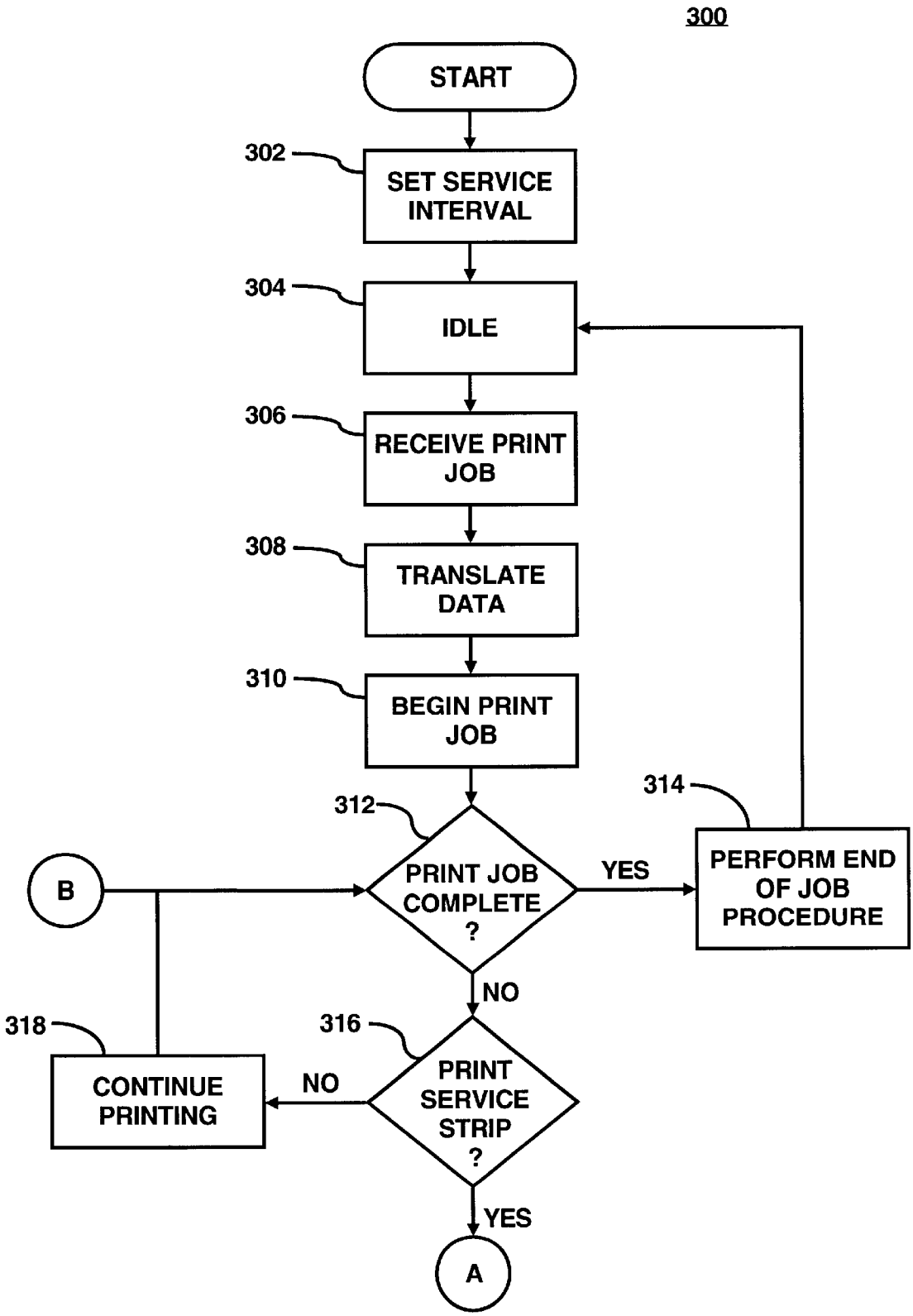
FIGS. 3A and 3B collectively illustrate a flow diagram of a method according to an embodiment of the invention.
Figure 3B:
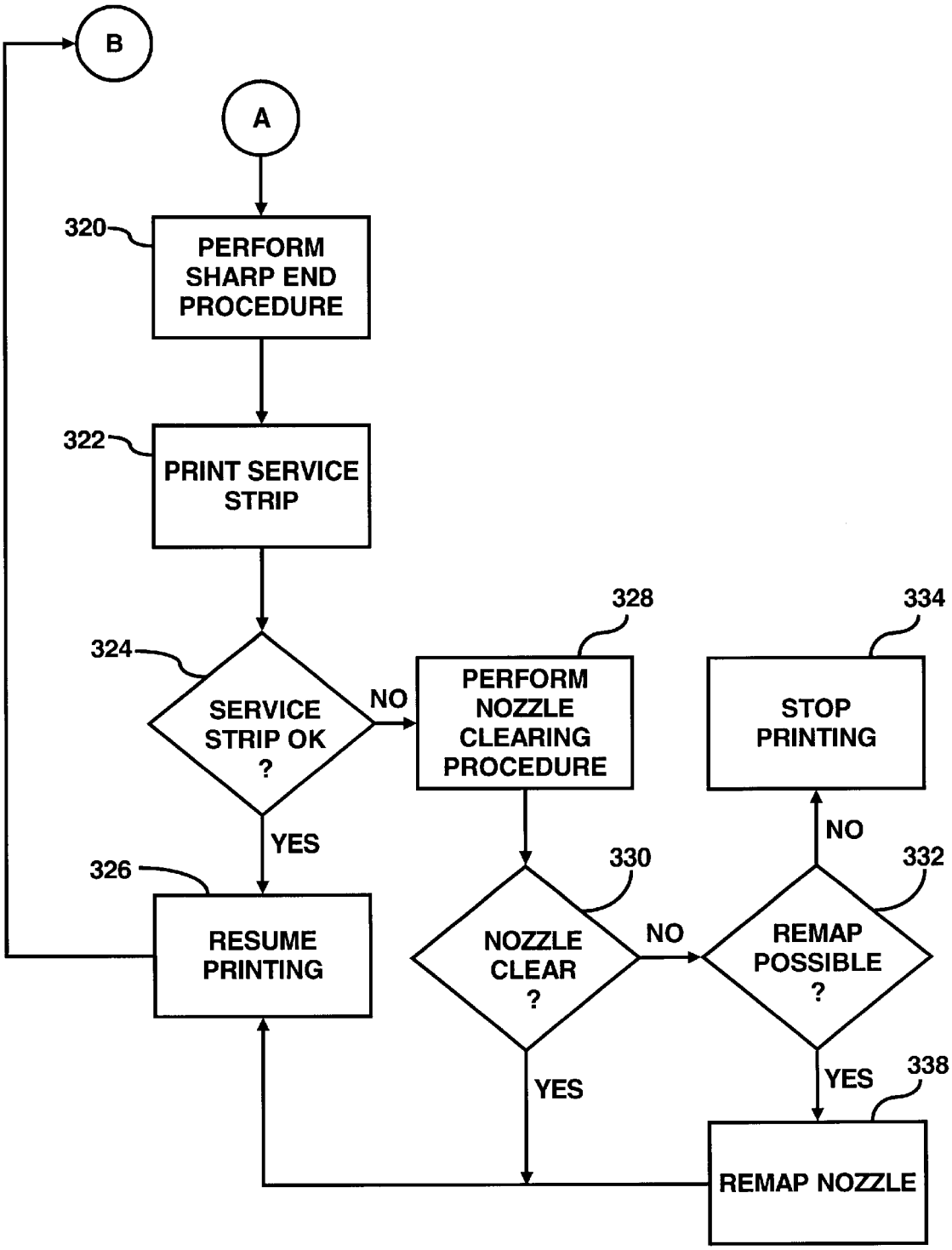

FIGS. 3A and 3B collectively illustrate a flow diagram of a method 300 according to an embodiment of the invention. In general, the method 300 may increase reliability of a print job. As shown in FIG. 3A, at step 302, the user is provided an opportunity to set one or more servicing intervals. For example, the user may access the control panel 218 and/or the host device 214 (as illustrated in FIG. 2) to set the servicing interval. Additionally, in a manner similar to setting servicing intervals, the user may set one or more print modes (e.g., image quality threshold, print speed, etc.). Furthermore, while setting the servicing interval(s) is depicted as occurring prior to receiving a print job, the invention is not limited to setting the servicing interval(s) prior to receiving the print job, but rather, the servicing interval(s) may be set at anytime prior to or during the printing of the print job.

The servicing interval may be set based on a number of criteria such as downstream processing, image quality, the length of the print job, etc. For example, in a thirty meter long print job in which the printed medium is to be subsequently cut into one meter long segments, the servicing interval may be set to one meter or increments of one meter. To continue this example, if the printer reliably prints twelve meters without defect, the servicing interval may be set to twelve meters, however, it may be relatively more efficient to set the servicing interval to ten meters in order to produce evenly spaced printing increments (e.g., three printed swaths, each swath being ten meters). In this manner, a single value may be utilized to set a plurality of servicing intervals.

Additionally, while setting the plurality of servicing intervals to a single value is mentioned above, this embodiment of the invention is not limited to setting the plurality of servicing interval to a single value, but rather, each servicing interval may be independently set. For example if the print medium is to be utilized to make blouses and matching slacks, the servicing interval may alternate between two values, one value corresponding to the blouses and the second value corresponding to the slacks. In another example, if dresses in a range of sizes (e.g., size 5 to size 16) are to be produced with the print medium, the servicing interval may change accordingly. In this manner, a user may determine the servicing interval(s) and set the servicing interval(s) via the control panel 218 or via the host device 214 as shown in FIG. 2. Furthermore, it is within the scope of the invention that the servicing interval(s) be determined and set automatically based on a variety of factors such as downstream processing of the print job, pattern repetition within print content, length of the print job, expected defect rate of the printer, etc.

Following step 302, the method 300 may idle, or wait to receive a print job at step 304. While in one form of the method 300, step 304 may follow step 302, in various other forms of the method 300, step 302 may be performed at any time prior to or during the method 300.

In response to receiving a print job, the method 300 may proceed to step 306. The print job may be received in any manner known to those skilled in the art. In a preferred form, the print job may be received by the I/O interface 216 from the host device 214 and forwarded to the controller 210 as illustrated in FIG. 2. The controller 210 may store the print job to the memory 212 and/or the controller 210 may translate data associated with the print job into printable data (e.g., rasterization process, printer specific commands, etc.) at step 308. In various other forms of the method 300, data translation performed may be performed prior to the method 300 or may not be required, thus step 308 may be optional. Following step 308, the method 300 may proceed to step 310.

At step 310, printing may be initiated. In a preferred form, a service strip may be printed just prior to initiation of the print job. It is also preferable that during the printing of the print job, diagnostic printing on one or both edges of the print medium (e.g., diagnostic selvage printing) be performed. Typically, diagnostic selvage printing may be insufficient to fully assess the health of the printhead nozzles, however, one or more types of printing errors may be detected in this manner. Thus, diagnostic selvage printing may be utilized to further reduce printing errors. Following step 310, the method 300 may proceed to step 312.

At step 312, it may be determined if the print job has been completed. For example, the controller 210 (as depicted in FIG. 2) may access data associated with the print job to determine if an end of file ("EOF") marker has been reached. If it is determined that the print job has been completed, the method 300 may proceed to step 314. If it is determined that at least some of the print job remains to be printed, the method 300 may proceed to step 316.

At step 314, the method 300 may perform an "end of job" ("EOJ") procedure. The EOJ procedure may be performed, for example to produce a relatively sharp edge at the end of the print job (e.g., reduce the occurrence of interleaving). A variety of printer operations and/or data operations associated with the EOJ are known to those skilled in the art and may be included in the step 314. Following step 314, the method 300 may return to step 304.

At step 316, it may be determined if a service strip is to be printed. For example, the controller 210 may reference the data associated with the print job and the servicing interval to determine if a service strip is to be printed. If it is determined that the print job is to continue, the method 300 may proceed to step 318. If it is determined a service strip is to be printed, the method 300 may proceed to step 320.

At step 318, the print job may continue to be printed. For example, the controller 210 may continue to reference data associated with the print job and in the manner described above, the controller 210 may continue to control the printer 200 to produce the print job.

At step 320, one or more procedures may be performed prior to printing a service strip. In general, the procedure(s) performed at step 320 may reduce waste of the print medium. In this regard, the procedure(s) may include a procedure similar to the EOJ procedure performed at step 314. Additionally, the procedure(s) may include various methods of producing a relatively sharp end between where the print job is interrupted and where the service strip is to be printed. Following step 320, the method 300 may proceed to step 322.

At step 322, a service strip may be printed. In one form, the print medium may be advanced slightly prior to printing the service strip so that an unprinted area of print medium may serve as a delineation between the print job and the service strip. In another form, the printhead may be moved slightly (left or right as appropriate) prior to printing the service strip so that an unprinted area of print medium may serve as a delineation between the print job and the service strip. In yet another form, the delineation may be generated by printing in a manner relatively different from the print job and the service strip. For example, a neutral color, a checker board pattern and the like may be printed to serve as a cut indicator. In yet another form, the delineation may be generated by printing slightly more (e.g., 0.5 cm) of the print job. For example, in a print job having a repeated pattern, a subset of an additional pattern may be printed to serve as a means for joining one segment of printed content to another. In various other forms, the service strip may be printed immediately adjacent to the print job so as to minimize loss of print medium.

In general, steps 322 to 338 may be described as diagnostic printing and repair. In this regard, following the printing of the service strip, the service strip may be evaluated at step 324. For example, an optical sensing system attached to the carriage may be configured to scan the service strip. Data associated with the scan of the service strip may be compared to data associated with expected scan results and a determination may be made based on the comparison. If it is determined that the service strip is acceptable, the service strip may proceed to step 326. If it is determined an error is present in the service strip, the method 300 may proceed to step 328.

At step 326, a delineation between the service strip and the print job may be produced in a manner similar to producing the delineation at step 320. Additionally, a relatively small amount (e.g., 0.5 cm and the like) of the print job may be repeated prior to the print job being resumed. For example, the controller 210 may access the printable data associated with the print job just prior to (e.g., 0.5 cm and the like) the printing of the service strip at step 320 and repeat that segment of printing before continuing the print job. In this manner, an overlapping section of print medium may be generated to facilitate connection of the print medium after removing (i.e., cutting out) the service strip from the completed print job. Regardless of whether the delineation and/or the overlapping segment is produced, printing may resume. In a preferred form, the printing may resume as a "sharp end" start, similar to the start of a print job. Following step 326, the method 300 may return to step 312.

At steps 328 to 338, various repair procedures may be performed. For example, at step 328, nozzle clearing procedure(s) may be performed. The condition of the nozzle (s) may be evaluated at step 330. If it is determined the one or more nozzles are clear, the method 300 may proceed to step 326. If it is determined the one or more nozzles are defective (e.g., clogged, below a predetermined level of functionality, etc.) it may be determined if the nozzle(s) may be remapped at step 332. In this regard, in a preferred form, a number of nozzles on each printhead (e.g., 12 to 20) may be held in reserve. In this manner, the function of a nozzle determined to be unacceptable may be replaced by a reserve nozzle. Further at step 332, the function of the reserve nozzle(s) may be checked, repaired, etc., in any manner known to those skilled in the art. If it is determined that the defective nozzle may not be remapped, the method 300 may proceed to step 334. If it is determined the defective nozzle may be successfully remapped, the method 300 may proceed to step 338.

At step 334, the method 300 may stop the print job. In a preferred form, the method 300 may idle until the user intervenes. Additionally, the method 300 may go into an error mode. For example, the controller 210 may control the control panel 218 to display an error message, etc.

At step 338, the defective nozzle(s) may be remapped in any manner known to those skilled in the art. Following step 338, the method 300 may proceed to step 326.

In another form, at steps 328 to 338, various other procedures may be performed based on the evaluation of the service strip. For example, if it is determined that the printer is not capable of producing the selected image quality threshold, the method 300 may go into an alarm mode and/or stop printing. In this manner, an unattended printer may be capable of essentially stopping a print job and thus reducing waste of print medium due to sub-standard printing.

The method 300 may exist in a variety of forms both active and inactive. For example, they may exist as software program(s) comprised of program instructions in source code, object code, executable code or other formats. Any of the above may be embodied on a computer readable medium, which include storage devices and signals, in compressed or uncompressed form. Exemplary computer readable storage devices include conventional computer system RAM (random access memory), ROM (read only memory), EPROM (erasable, programmable ROM), EEPROM (electrically erasable, programmable ROM), flash memory, and magnetic or optical disks or tapes. Exemplary computer readable signals, whether modulated using a carrier or not, are signals that a computer system hosting or running the computer program may be configured to access, including signals downloaded through the Internet or other networks. Concrete examples of the foregoing include distribution of the program(s) on a CD ROM or via Internet download. In a sense, the Internet itself, as an abstract entity, is a computer readable medium. The same is true of computer networks in general.

FIG. 4 is an illustration of an exemplary manner 400 in which a servicing interval may be defined, according to an embodiment of the invention. FIG. 4 includes a print medium 402. Printed onto the surface of the print medium 402, a print job may be depicted having a beginning 404, an end 406 and a length 408. The print job may be essentially segmented into a plurality of print contents 410–414. Additionally, FIG. 4 depicts a plurality of service strips 416–420. As described above, the service strip 416 may be printed prior to the print job. Furthermore, as also described above, the service strips 418 and 420 may be printed during the print job.

Thus, for the purpose of illustration, a servicing interval may be defined as a measured length of the print medium 402 between the beginning of the print job 404 and the service strip 418. Another servicing interval may be defined as a measured length of the print medium 402 between the service strip 418 and the service strip 420. Yet another servicing interval may be defined as the measured length of the print medium 402 between the service strip 420 and the end 406 of the print job. While three servicing intervals are illustrated in FIG. 4, it is too be understood that the invention is not limited to three servicing interval, but rather, any reasonable number of servicing intervals may be employed in the invention. Furthermore, while in one form the servicing intervals may be the same length, in various other forms, some or all of the servicing intervals may be different lengths.

FIG. 5 is an illustration of another exemplary manner 500 in which a servicing interval may be defined, according to an embodiment of the invention. FIG. 5 includes a print medium 502. The print medium may include a 1st selvage 504 and a second selvage 506. Printed onto the surface of the print medium 502, a print job may be depicted having a beginning 508, an end 510 and a length 512. The print job may be essentially segmented into a plurality of print contents 514 and 516. Each of the print contents 514 and 516 may further be defined by edges running the length of the print job. In this regard, the print content 514 may include a 1st edge 518 and a 2nd edge 520 and the print content 516 may include a 3rd edge 522 and a 4th edge 524. Additionally, FIG. 5 depicts a plurality of service strips 526 and 528. Although not shown in FIG. 5, as described above, an additional service strip may be printed prior to the print job. Furthermore, as described with reference to FIG. 3, the service strips 526 and 528 may be printed during the print job.

Thus, for the purpose of illustration, a servicing interval may be defined as a measured width of the print medium 502 between the 1st selvage 504 and the service strip 526. Another servicing interval may be defined as a measured width of the print medium 502 between the service strip 526 and the service strip 528. Yet another servicing interval may be defined as the measured width of the print medium 502 between the service strip 528 and the 2nd selvage.

While three servicing intervals are illustrated in FIG. 5, it is too be understood that the invention is not limited to three servicing intervals, but rather, any reasonable number of servicing intervals may be employed in the invention. Furthermore, while in one form, the servicing intervals may be the same width, in various other forms, some or all of the servicing intervals may be different lengths. Moreover, the invention is not limited to the manner of defining the servicing interval(s) as described above, but rather, any reasonable manner of describing the servicing interval(s) may be employed and thus are within the scope of the invention. For example, the servicing intervals may be defined with regard to the 1st edge 518 and the 2nd edge 520, etc.

What has been described and illustrated herein is a preferred embodiment of the invention along with some of its variations. The terms, descriptions and figures used herein are set forth by way of illustration only and are not meant as limitations. For example, the steps illustrated in FIGS. 3A and 3B need not be performed in the order illustrated, but rather, may be performed in any reasonable order. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A method for improving the image quality of a print job, the method comprising:

initiating the print job, the print job having a print length and a print width;

substantially interrupting the print job and printing a service strip in response to at least one of the print length and the print width exceeding a servicing interval, the servicing interval being modifiable;

evaluating the service strip;

determining whether the image quality of the print job is above a predetermined quality threshold based on the evaluation of the service strip; and resuming the print job in response to the print job being above the predetermined quality threshold.

2. The method according to claim 1, further comprising:

entering an alarm mode in response to the print job being below the predetermined quality threshold.

3. The method according to claim 1, further comprising:

stopping the print job in response to the print job being below the predetermined quality threshold.

4. The method according to claim 1, further comprising:

providing a user the capability to modify the servicing interval.

5. The method according to claim 1, wherein the predetermined quality threshold is based on a selected print mode.

6. The method according to claim 1, further comprising:

performing a repair procedure in response to the print job being below the predetermined quality threshold.

7. The method according to claim 6, further comprising:

determining a defective nozzle in response to the print job being below the predetermined quality threshold and wherein the repair procedure includes one or more of firing the defective nozzle, wiping the defective nozzle, testing the defective nozzle and remapping the defective nozzle.

8. The method according to claim 6, further comprising:

determining whether the repair procedure is successful;

resuming the print job in response to the repair procedure being successful; and stopping the print job in response to the repair procedure being unsuccessful.

9. The method according to claim 1, further comprising:

producing a delineation between the service strip and the print job.

10. The method according to claim 9, wherein the delineation is produced by one or more of not printing on an area of the print medium, printing a neutral color as the delineation, printing a content associated with the print job as the delineation and printing a content different from the print job as the delineation.

11. A system for improving the image quality of a print job comprising:

a processor configured to control a printer to initiate the print job, the print job having a print length and a print width, wherein the processor is further configured to control the printer to pause the print job and print a service strip on a print medium in response to at least one of the print length and the print width exceeding a servicing interval, the servicing interval being modifiable; and a sensor system configured to sense the service strip and relay data associated with the sensing of the service strip to the processor, the processor being further configured to evaluate the service strip based on the data associated with the sensing of the service strip and determine whether the image quality of the print job is above a predetermined quality threshold based on the evaluation of the service strip, wherein the processor is further configured to control the printer to resume the print job in response to the print job being above the predetermined quality threshold.

12. The system according to claim 11, wherein the processor is further configured to enter an alarm mode in response to the print job being below the predetermined quality threshold.

13. The system according to claim 11, wherein the processor is further configured to stop the print job in response to the print job being below the predetermined quality threshold.

14. The system according to claim 11, further comprising:

a user interface configured to provide a user the capability to set the servicing interval.

15. The system according to claim 11, wherein the processor is further configured to determine a quality threshold based on a selected print mode.

16. The system according to claim 11, wherein the processor is further configured to control the printer to perform at least one repair procedure in response to the print job being below the predetermined quality threshold.

17. The system according to claim 16, wherein the processor is further configured to:

determine whether the repair procedure is successful;

control the printer to resume the print job in response to the repair procedure being successful; and control the printer to stop the print job in response to the repair procedure being unsuccessful.

18. The system according to claim 11, wherein the processor is further configured to control the printer to produce a delineation on the print medium between the service strip and the print job.

19. The system according to claim 18, wherein the processor is further configured to control the printer to produce the delineation on the print medium by one or more of advancing the print medium without printing, advancing a printhead without printing, printing a neutral color on the print medium, printing a content associated with the print job on the print medium and printing a content different from the print job on the print medium.

20. An apparatus comprising:

a printhead configured to print on a print medium;

a controller configured to control the printhead to print a print job on the print medium, the print job having a print length and a print width, wherein the controller is further configured to control the printhead to pause the print job and print a service strip on the print medium in response to at least one of the print length and the print width exceeding a servicing interval, the servicing interval being modifiable; and a sensor configured to sense the service strip and relay data associated with the sensing of the service strip to the controller, the controller being further configured to evaluate the service strip based on the data associated with the sensing of the service strip and determine whether the image quality of the print job is above a predetermined quality threshold based on the evaluation of the service strip, wherein the controller is further configured to control the printhead to resume the print job in response to the print job being above the predetermined quality threshold.

21. The apparatus according to claim 20, wherein the controller is further configured to enter an alarm mode in response to the print job being below the predetermined quality threshold.

22. The apparatus according to claim 20, wherein the controller is further configured to stop the print job in response to the print job being below the predetermined quality threshold.

23. The apparatus according to claim 20, further comprising:

a user interface configured to provide a user the capability to set the servicing interval.

24. The apparatus according to claim 20, wherein the controller is further configured to determine a quality threshold based on a selected print mode.

25. The apparatus according to claim 20, wherein the controller is further configured to control the printhead to perform at least one repair procedure in response to the print job being below the predetermined quality threshold.

26. The apparatus according to claim 25, wherein the controller is further configured to:

determine whether the repair procedure is successful;

control the printhead to resume the print job in response to the repair procedure being successful; and control the printhead to stop the print job in response to the repair procedure being unsuccessful.

27. The apparatus according to claim 20, wherein the controller is further configured to control the printhead to produce a delineation on the print medium between the service strip and the print job.

28. The apparatus according to claim 27, wherein the controller is further configured to produce the delineation on the print medium by one or more of controlling a roller to advance the print medium without printing, controlling the printhead to advance without printing, controlling the printhead to print a neutral color on the print medium, controlling the printhead to print a content associated with the print job on the print medium and controlling the printhead to print a content different from the print job on the print medium.

* * * * *